United States Patent [19]

Spurlock

[11] Patent Number: 4,641,479

[45] Date of Patent: Feb. 10, 1987

[54] CLOSURE INSERT FOR USE IN BUILDING CONSTRUCTION

[76] Inventor: Jay B. Spurlock, 17629 Maple Valley Rd., SE., Maple Valley, Wash. 98038

[21] Appl. No.: 626,745

[22] Filed: Jul. 2, 1984

[51] Int. Cl.[4] ..... E04H 5/00

[52] U.S. Cl. ..... 52/241; 52/64

[58] Field of Search ..... 52/64, 632, 126.3, 126.5, 52/126.6, 126.7, 302, 393, 398, 399, 401, 479, 481, 240, 241, 573; 160/376

[56] References Cited

U.S. PATENT DOCUMENTS

| | | | |
|---|---|---|---|
| 2,595,595 | 5/1952 | McKay | 160/376 |
| 3,453,789 | 7/1969 | Stephenson | 52/126.3 |
| 3,699,734 | 10/1972 | Craig et al. | 52/401 |
| 3,720,026 | 3/1973 | Gasteiger | 52/401 X |
| 3,967,420 | 7/1976 | Papsco et al. | 52/241 X |
| 4,103,463 | 8/1978 | Dixon | 52/241 X |
| 4,277,920 | 7/1981 | Dixon | 52/64 |

FOREIGN PATENT DOCUMENTS

| | | | |
|---|---|---|---|
| 2522067 | 4/1975 | Fed. Rep. of Germany | 52/126.3 |
| 2459443 | 11/1975 | Fed. Rep. of Germany | 52/240 |

*Primary Examiner*—William F. Pate, III
*Assistant Examiner*—Creighton Smith
*Attorney, Agent, or Firm*—Jensen & Puntigam

[57] ABSTRACT

A closure element comprising two opposing vertical U-shaped end sections (16,18) with two opposing vertical side pieces (22,24) extending, respectively, between opposing side portions of the end sections. Insulation (26) is packed into the interior of the closure insert (10) to maintain the side pieces (22, 24) in place against the interior surfaces of the side portions of the end sections (16, 18). Otherwise, the end sections (16,18) and the side pieces (22,24) are arranged so that they can move relative to each other to maintain complete closure of the space in which the closure insert (10) is positioned. Foam backed tape (40) is used between the end sections (16,18) and the adjacent building walls/columns to maintain mating contact therebetween.

4 Claims, 3 Drawing Figures

CLOSURE INSERT FOR USE IN BUILDING CONSTRUCTION

DESCRIPTION

1. Technical Field

The present invention relates generally to the art of building construction, and more specifically concerns a structural element which mates the end of an interior wall and/or the side of a column of a building to an exterior wall thereof.

2. Background of the Invention

High rise buildings are typically constructed with a complete exterior and the required basic interior mechanical and structural elements, including roughed-in floors and ceilings. Interior columns are usually present, their location being dependent upon the design of the particular building. In the finishing of office/living space on the individual floors of such buildings, interior walls are added and finished, as are the floors and ceilings. In some cases, the interior walls which are added are permanent or semi-permanent, while in other cases the walls are relatively portable. The interior columns, of course, are stationary because they are a structural part of the building.

In such construction, particularly around the windows of the building, there typically is a space between the end of an interior wall or an interior column and the inner surface of the exterior wall or window mullion. This space is usually closed by a wallboard or similar material filler element. The wallboard filler is taped and painted with the rest of the office space. After a time, however, as the building moves and settles, the wallboard insert often pulls away from the exterior wall of the building, leaving a gap between the wallboard filler and the wall, often as great as ½ inch or even more. This is quite undesirable, as it not only presents a poor appearance, but it results in a lack of privacy for adjacent offices, as conversation in one office can be easily overheard in an adjacent office. Further, such gaps between the wallboard and the wall are expensive to repair, and they often reoccur, requiring further repair. The building construction industry has been searching for some time for a practical solution to the above problem, and to the best of the inventor's knowledge, has been unable to obtain a practical solution.

The following patents relating to wall and closure construction in buildings are known to the applicant: U.S. Pat. Nos. 2,443,548 to Wilson, 2,963,131 to Brockway, 3,182,423 to Jennings, 3,203,147 to Penley, 3,408,781 to Pollock, and 4,433,516 to Fricker. The closest references appear to be the patents to Wilson and Pollock, although they deal with partitions and not closure inserts. None of the above references teach the structure of the closure insert disclosed and claimed herein.

DISCLOSURE OF THE INVENTION

Accordingly, the present invention is an expandable closure insert which is useful in building construction to close the area between an exterior portion of the building such as a wall or window mullion and an interior element such as a wall or column. The insert includes two opposing U-shaped vertical end channel members, one of which is adjacent the exterior portion and the other of which is adjacent the interior element when the closure insert is in place. The insert also includes two opposing flat vertical side panel members which extend, respectively, between the opposing sides of said end channel means, thereby defining a continuous vertical surface bordering an interior volume, wherein the end channel members and the side panel members are arranged such that said two end channel members can move laterally relative to each other and said side panel members so that the area between the exterior portion and the interior element always remains closed.

BEST MODE FOR CARRYING OUT THE INVENTION

The closure insert of the present invention is adapted to be used to join the exterior wall of a building, such as a high rise office building, with the end of an interior wall and/or the side of a column, to complete individual office space in the building. The closure insert can also be used between the end of the interior wall and/or column and the mullion or frame surrounding a window. Usually this space will be hidden to an extent by a curtain or similar window covering.

Presently, as explained above, the closure of such space is accomplished by conventional construction techniques, including, for instance, the use of wallboard which is taped and painted. However, normal movement of the building will frequently cause a separation of the wallboard closure element from the exterior wall, resulting in a communication of noise and other conversation between adjacent offices. This closure problem is a source of frequent complaints for building tenants, although it is recognized that the problem is difficult and expensive to correct.

Figure 1:
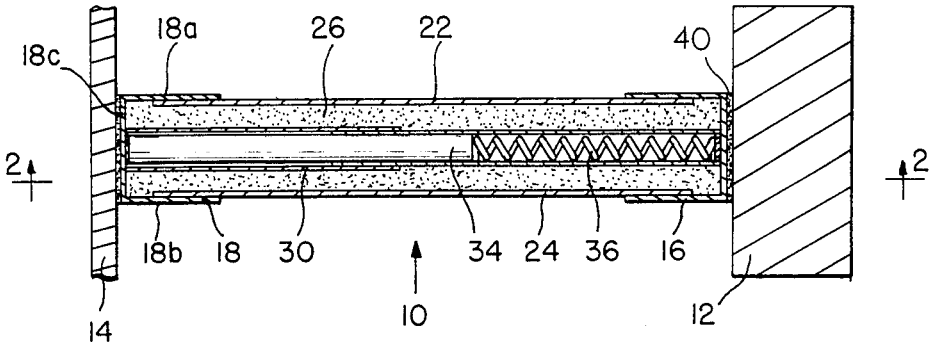
FIG. 1 is a horizontal cross-sectional view of the closure insert article of the present invention.
Figure 2:
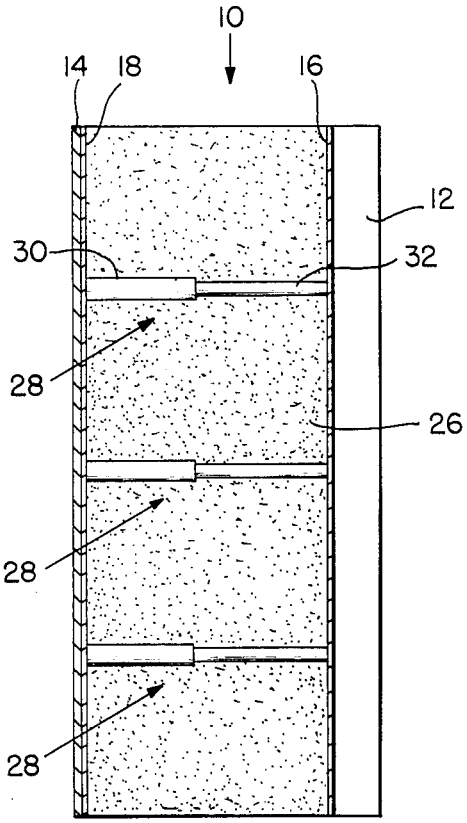
FIG. 2 is a vertical cross-sectional view of the closure insert, taken along lines 2—2 in FIG. 1.

Referring now to FIGS. 1 and 2 in particular, the closure insert is shown generally at 10, positioned between an exterior wall or window mullion 12 of the building, and an interior wall or column 14. The insert 10 is also appropriate for use in other similar contexts in building construction.

The insert 10 includes two vertical end sections 16 and 18. In the embodiment shown, the end sections 16 and 18 are U-shaped in cross-section and comprise 25 gauge sheet metal. In a typical installation, end sections 16 and 18 are approximately 6 feet high and 2½ inches wide. It should be understood, however, that the end sections may vary in size considerably within the scope of the present invention. For instance, the end sections will typically vary in height from 3 feet to 9 feet, in accordance with the design of the building. The width of the end section can also vary widely, in accordance with the architect's specifications.

The end sections 16 and 18 in the embodiment shown comprise two opposing side portions, for instance 18*a* and 18*b* of end section 18, with a connecting intermediate portion 18*c*, which is, in use of the article positioned adjacent either the interior wall (or column) or the exterior wall (or mullion). The side portions 18*a* and 18*b* as shown extend outwardly from the wall a substantial distance, in the embodiment shown approximately 2–3 inches, while the intermediate section in the embodiment shown is 2½ inches wide, as stated above.

The insert 10 further includes two vertical side pieces 22 and 24 which extend between the respective end sections and thus form the two vertical sides of the closure insert. The side pieces 22 and 24 have the same height as the end sections 16 and 18, and have a width which is slightly less than the distance to be filled by the insert, i.e. the distance between interior wall 14 and exterior wall 12. In the embodiment shown, the side pieces are also made of 25 gauge sheet metal. The respective edge portions of the front surface of each side piece 22 and 24 abut against the interior surface of the side portions of the two end sections 16 and 18 and are arranged relative to the side pieces 22 and 24 such that the end sections 16 and 18 can move toward and away from each other, thus increasing or decreasing the amount of overlap relative to the side pieces.

The interior of the closure insert, bounded by the two end sections 16, 18 and the two side pieces 22, 24, is filled with a conventional insulation material 26, which in the embodiment shown is loose fiberglass insulation, having specified sound and fire retardant characteristics. In the embodiment shown, insulation 26 is packed into the closure insert 10 so as to force the side pieces 22, 24 out against the side portions of the end sections, so that no structural connection between the end sections and the side pieces is necessary. Such an arrangement is relatively simple, yet still permits the desired movement of the end sections relative to the side pieces.

In the embodiment shown, both the top and the bottom of the closure insert are open. However, it should be understood that the insert could be provided with either a top and/or a bottom U-shaped channel cap, which would close off the top and/or bottom of the panel. The top/bottom channel cap is the same width as the side pieces and fits flush with the top of the end sections. The depending side portions of the channel fit between the side portions of the end sections and the side pieces. The cap is also in the embodiment shown of 25 gauge sheet metal.

Figure 3:
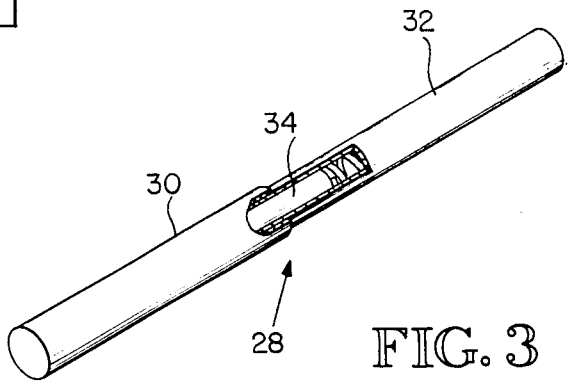
FIG. 3 is a perspective, partially cutaway, view of one portion of the closure insert of FIGS. 1 and 2.

In the embodiment shown, three spacers 28—28 are provided within the interior of the closure insert, extending between the opposing end sections 16 and 18. The spacers 28, being spring-loaded, apply pressure against the end sections, tending to force them apart and against the respective exterior wall and interior wall of the building. The spacers are shown in FIGS. 1 and 2 and in more detail in FIG. 3.

Typically, in a closure insert approximately six feet high, there will be three spacers positioned at regular intervals. Each spacer 28 in the embodiment shown is cylindrical in general configuration, approximately $1\frac{1}{4}$ inches in diameter and comprises two sleeve portions 30 and 32, which are arranged such that one sleeve portion fits just inside the other and has a slidable relationship relative thereto. Positioned in the interior of spacer 28 is a cylindrical spacer block 34 and a spacer spring 36. The spring 36 acts against the block 34, tending to force the two sleeve portions 30 and 32 apart.

The spacer is dimensioned such that when it is inserted into the interior of the closure insert, as shown in FIGS. 1 and 2, it is under sufficient tension to exert a force outwardly against the two end sections 16 and 18. Although the embodiment shown utilizes three spacer blocks, it is possible that fewer or more spacer blocks could be used in a particular embodiment.

Secured to the respective ends of the closure insert are strips of conventional foam backed tape 40. The tape abuts the end of the interior wall or side of the interior wall, or the exterior wall or mullion, but is not secured to them. There is thus a continuous mating contact between both ends of the closure insert and the adjoining wall or column, maintained by the spacers.

In one embodiment there are no spacers in the closure insert. In this embodiment, double sided tape is used to positively secure the end sections to the adjacent wall or column.

In use, the closure insert will typically be fabricated away from the construction site to the desired dimensions, with the exterior painted or perhaps wrapped with vinyl or cloth to match the building space which is being finished. The foam backed tape is applied to the closure insert and the closure insert compressed somewhat and bound by tape and/or wire or similar means. The closure insert is then delivered to the job site and placed into the desired position between the respective walls and columns. The binding is then removed and the closure insert expands to completely fill the space. Since the end sections of the closure insert are maintained in contact with the adjacent column or wall, the closure insert will not separate from the building due to movement of the building or other cause. The end sections of the insert will move relative to the side pieces to accommodate any change in the distance between the column and the walls.

Thus, a closure insert has been described which is useful in construction of buildings, particularly high rise buildings, and which conveniently and in a practical way solves the problem now present in the construction trade relative to permanent closure of space between permanent exterior walls and/or mullions and interior walls and/or columns.

Although a preferred embodiment of the invention has been disclosed herein for purposes of illustration, it should be understood that various changes, modifications and substitutions may be incorporated in such embodiment without departing from the spirit of the invention as defined by the claims which follow.

I claim:

1. A self-contained insert for use in building construction to close the area between an exterior portion of the building such as a wall or a window mullion and an interior element such as a wall or column without altering either the exterior portion of the building or the interior element, the insert comprising:

two opposing, vertical, inwardly opening U-shaped end channel members, each of said channel members comprising two parallel extending side walls and an intermediate end wall, the end walls of the two channel members each having an outer surface which is adapted to provide substantial, continuous contact with the exterior portion of the building and the interior element, respectively, when the closure insert is in place;

two opposing, vertical, flat side panel members, extending respectively between, opposing side walls of the two channel members, with the channel members overlapping the side panel members, each panel member having top and bottom edges and two side edges and exterior and interior panel surfaces, wherein the exterior panel surface of each panel member, in the area adjacent the respective side edges thereof, fits flush against the interior surface of the respective opposing side walls of the channel members, and wherein the two panel members are not connected directly to each other or to said channel members, so that the two panel members are free to move independently relative to said channel members and each other, in response to relative movement between the exterior portion of the building and the interior element;

insulation positioned between said first and second panel members for maintaining the flush contact between the panel members and the side walls of the channel members; and a plurality of spring-biased, telescoping spacer members which extend between the two channel members, tending to maintain the end walls of the channel memebers in contact with the exterior portion of the building and the interior element, respectively.

2. A self-contained insert for use in building construction to close the area between an exterior portion of the building such as a wall or window mullion and an interior element such as a wall or column without altering either the exterior portion of the building or the interior element, the insert comprising:

two opposing, vertical, single piece end channel members, each of said end channel members having a vertical surface which is adapted to provide substantial continuous contact with the exterior portion of the building and the interior element, respectively, when the closure insert is in place;

two opposing, vertical, flat side panel members extending, respectively, between the opposing sides of said end channel members with the channel members overlapping the side panel members, thereby defining a continuous vertical surface bordering an interior volume, said side panel members being constructed and arranged such that the two panel members are free to move independently relative to said channel members and each other, in response to relative movement between the exterior portion of the building and the interior element without interrupting the continuous vertical surface; and means for maintaining the continuous contact between said vertical surface of the respective end channel members and the exterior portion of the building and the interior element.

3. An apparatus of claim 2, wherein said maintaining means includes spring-biased spacer members which extend between the opposing end channel members, tending to maintain the vertical surfaces thereof in contact with the exterior portion of the building and the interior element, respectively.

4. A self-contained insert for use in building construction to close the area between an exterior portion of the building such as a wall or a window mullion and an interior element such as a wall or column without altering either the exterior portion of the building or the interior element, the insert comprising:

two opposing, vertical, single-piece end channel members, each of said end channel members with the channel members overlapping the side panel members having a vertical surface which is adapted to provide substantial, continuous contact with the exterior portion of the building and the interior element, respectively, when the closure insert is in place;

two opposing, vertical, flat side panel members extending, respectively, between the opposing sides of said end channel members, thereby defining a continuous vertical surface bordering an interior volume, said end channel members and said side panel members being arranged such that said two end channel members can move laterally relative to each other and the panel members, in response to relative movement between the exterior portion of the building and the interior element, without interrupting the continuous vertical surface; and means for maintaining the continuous contact between said vertical surface of the respective end channel members and the exterior portion of the building and the interior element.

* * * * *